US005839993A

United States Patent [19]

Fox

[11] Patent Number: 5,839,993

[45] Date of Patent: Nov. 24, 1998

[54] ARTICULATING STABILIZER FOR A FOLDING TREADMILL

[75] Inventor: Gary Tom Fox, Winona, Tex.

[73] Assignee: Keys Fitness Products, Inc., Dallas, Tex.

[21] Appl. No.: 889,671

[22] Filed: Jul. 8, 1997

[51] Int. Cl.[6] ..... A63B 22/02

[52] U.S. Cl. ..... 482/54

[58] Field of Search ..... 422/54, 51

[56] References Cited

U.S. PATENT DOCUMENTS

| | | |
|---|---|---|
| 931,394 | 8/1909 | Day . |
| 2,117,957 | 5/1938 | Heller . |
| 3,731,917 | 5/1973 | Townsend . |
| 4,026,545 | 5/1977 | Schonenberger . |
| 4,066,257 | 1/1978 | Moller . |
| 4,625,962 | 12/1986 | Street . |
| 4,664,646 | 5/1987 | Rorabaugh . |
| 4,974,831 | 12/1990 | Dunham . |
| 5,676,624 | 10/1997 | Watterson . |
| 5,772,560 | 6/1998 | Watterson . |

OTHER PUBLICATIONS

Genesis 4000 brochure, copyright Genesis, Inc. 1985.

Brochure, "Technology for Total Fitness," Genesis 2000, 1985.

Brochure, "Taiwan Sports Goods Buyers' Guide '95," Tradewinds, 1995, Cover page plus pp. 20,21,197,317 and 327.

*Primary Examiner*—Lynne A. Reichard

*Attorney, Agent, or Firm*—Haynes and Boone, L.L.P.

[57] ABSTRACT

A treadmill folds for storage and includes a main frame structure, a pivoting frame, a resisting mechanism, an articulating structure, and an articulating mechanism. The pivoting frame pivotally mounts to the main frame structure along a main pivot axis such that a user may pivot the pivoting frame between a substantially vertical position and a substantially horizontal position. The pivoting frame supports a conveyor. The resisting mechanism applies a torsional resisting moment to the pivoting frame. The resisting moment opposes a moment which gravity induces on the pivoting frame. Upon moving the pivoting frame between the vertical position and the horizontal position, the articulating mechanism automatically articulates the articulating structure between a stored, retracted position and an extended position which stabilizes the treadmill.

23 Claims, 4 Drawing Sheets

ARTICULATING STABILIZER FOR A FOLDING TREADMILL

FIELD OF THE INVENTION

This invention relates to exercise equipment, and, more particularly, to treadmills which fold for storage.

BACKGROUND OF THE INVENTION

Exercise enthusiasts use treadmills to convey, on an endless track, a walking or running surface upon which the user may run or walk in place. Because treadmills must provide a surface which has a length which is greater than the stride of a user, and a width which exceeds the stance of the user, treadmills have historically required a significant amount of floor space for both operation and storage. Recently, however, the industry has produced a variety of treadmills in which the user may fold up the conveyor portion of the treadmill, including the supporting structure, into a vertical position for storage. This has substantially reduced the amount of floor space which the user must set aside for the treadmill when he or she is not using it.

In an effort to minimize the total package volume which a treadmill requires for packaging, it is desirable to reduce the folded depth of the treadmill. Reducing the folded depth, however, results in a corresponding reduction in the amount of longitudinal resistance to the rocking of the treadmill, and thus a reduction in the longitudinal stability of the treadmill. In an effort to minimize package size without decreasing longitudinal stability to dangerous levels, the industry has developed a variety of stabilizers which the user must bolt or otherwise attach to the main frame structure of the treadmill after purchase. For stabilizers which fasten via fasteners to the frame, the user is able to remove such fasteners only after significant effort. The user must find the proper tools, then remove the fasteners and the stabilizer, and store the lose parts such that they are available for later reassembly. This can be time consuming. Therefore, consumers sometimes neglect to install the stabilizer prior to use, thus increasing the likelihood of personal injury from use. In addition, the user may improperly install the stabilizer, resulting in a decreased ability to stabilize the treadmill.

In order to facilitate lowering of the conveyor portion of the treadmill, including the supporting structure, the industry generally uses gas springs to counteract the force of gravity. However, gas springs are linear devices, and, as such, they do not operate optimally when the moment arm length created between the axis of the gas spring and the pivot point vanes. The force vectors change as the pivoting frame lowers, thus varying the force with which the springs assist the user in lifting and lowering the pivoting frame. This results in an inconsistent lowering force which the user must resist. Such inconsistency can surprise the user, potentially causing him or her injury should he or she loose his grip on the treadmill. Further, gas springs have a life expectancy of about two years--less than two years if stored in anything but a vertical position. Further, gas springs are complex, costly, and may present a pinch point hazard to the user, or to a small child.

In addition, the folding or retracting operation may impart bending, flexing, or tensile stresses to wiring which attaches between the two portions of a typical folding treadmill which rotate with respect to each other. This may cause damage to the wiring.

Therefore, what is needed is a stabilizer which safely and automatically extends into position when the user places the treadmill in an operational position, and which automatically retracts when the user places the treadmill in a storage position. In addition, what is needed is a mechanism which resists the force which gravity imparts on the conveyor portion, and which supports the structure with a constant torsional moment. In addition, what is needed is a mechanism which provides a conduit through which wires can pass, such that lifting and lowering the conveyor will not subject the wires to tension, tangling, or bending, and which a technician can easily open for service.

SUMMARY OF THE INVENTION

According to the present invention, a treadmill is provided which folds for storage. The treadmill includes a main frame structure, a pivoting frame, a resisting mechanism, an articulating structure, and an articulating mechanism. The pivoting frame pivotally mounts to the main frame structure along a main pivot axis such that a user may pivot the pivoting frame between a substantially vertical position and a substantially horizontal position. The pivoting frame supports a conveyor. The resisting mechanism applies a torsional resisting moment to the pivoting frame. The resisting moment opposes a moment which gravity induces on the pivoting frame. Upon moving the pivoting frame between the vertical position to the horizontal position, the articulating mechanism automatically articulates the articulating structure between a stored, retracted position and an extended position in which the treadmill is stabilized.

In one feature of the invention, the articulating mechanism is a slider-crank mechanism. The articulating mechanism includes a stabilizer which extends horizontally from a mating structure. The mating structure is fixed to the main frame structure. A rod or linkage connects from an end of the stabilizer to a pivot on the pivoting frame. The pivot has an axis which is parallel to and not coaxial with the main pivot axis.

In another feature, the resisting mechanism includes at least one torsion spring at the main pivot axis. An end of the torsion spring anchors to the main frame structure. Another end anchors to the pivoting frame.

In another feature, the torsion spring mounts coaxially with respect to a hollow shaft. The hollow shaft is fixed to the main frame structure. The hollow shaft functions as both a pivot axle, on which the pivoting frame may pivot, and a conduit, through which wires may pass between the main frame structure and the pivoting frame.

DETAILED DESCRIPTION OF THE PREFERRED EMBODIMENT

Figure 1:
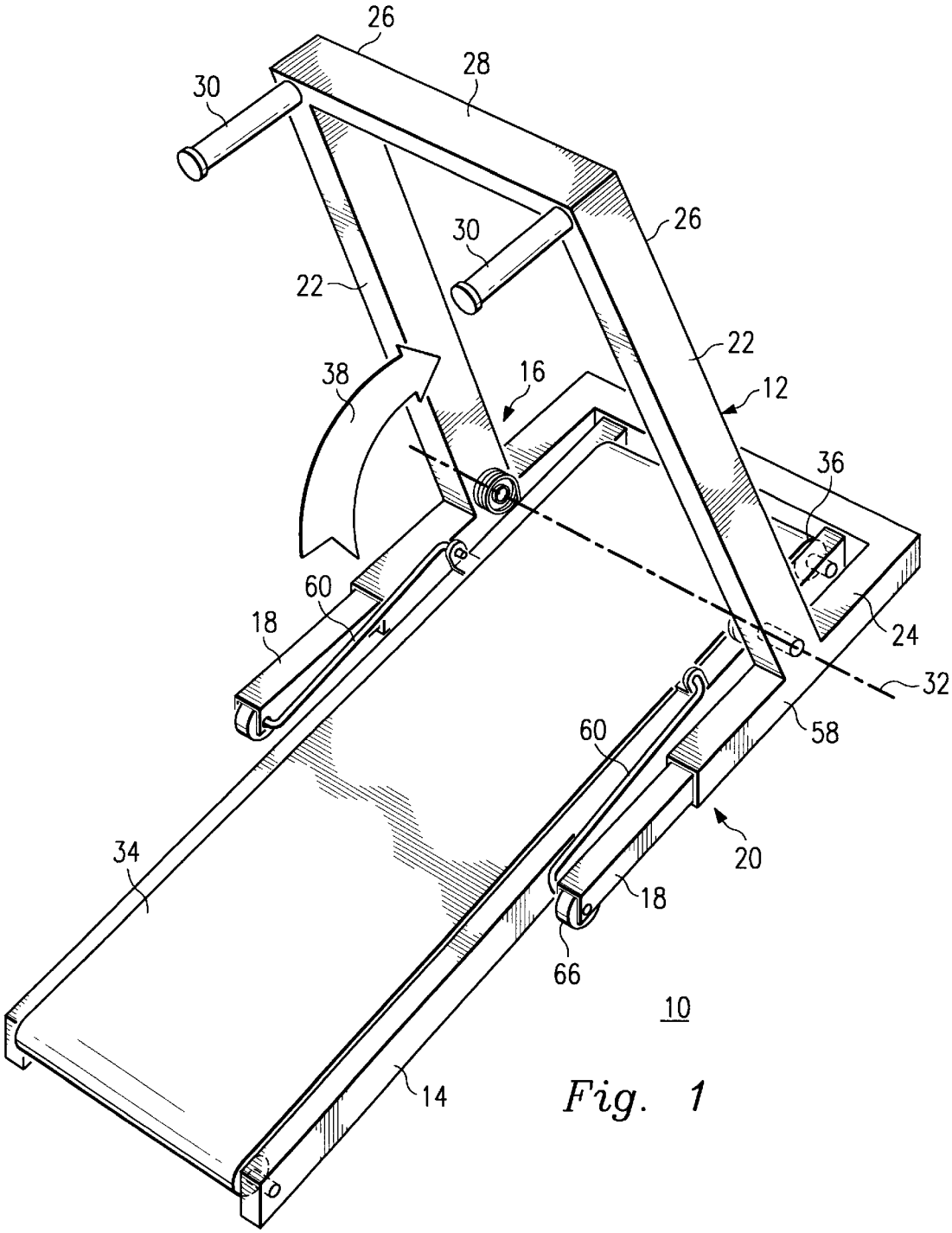
FIG. 1 is a perspective view of a preferred embodiment of the invention.

According to the present invention, as shown in FIG. 1, a treadmill 10 is provided which folds for storage. The treadmill 10 includes a main frame structure 12, a pivoting frame 14, a resisting mechanism 16, a stabilizer or articulating structure 18, and an articulating mechanism 20. The main frame structure 12 includes two upright portions 22 having lower ends 24 and upper ends 26. A cross member 28 connects the upper ends 26 of the upright portions 22. Handles or grips 30 attach to the upper ends 26, and provide support for a user (not shown) when the user operates the treadmill 10. The pivoting frame 14 pivotally mounts to the main frame structure 12 along a main pivot axis 32, such that the user may pivot the pivoting frame 14 from a substantially vertical position (shown in FIG. 2A) to a substantially horizontal position (shown in FIG. 2C). The pivoting frame 14 supports a conveyor 34 and related drive components 36.

The resisting mechanism 16 applies a torsional resisting moment 38 to the pivoting frame 14. The resisting moment 38 opposes a moment induced by gravity on the pivoting frame 14 and is greater than or equal to the minimum torsional moment necessary to hold the pivoting frame up when in the stored position.

Figure 3:
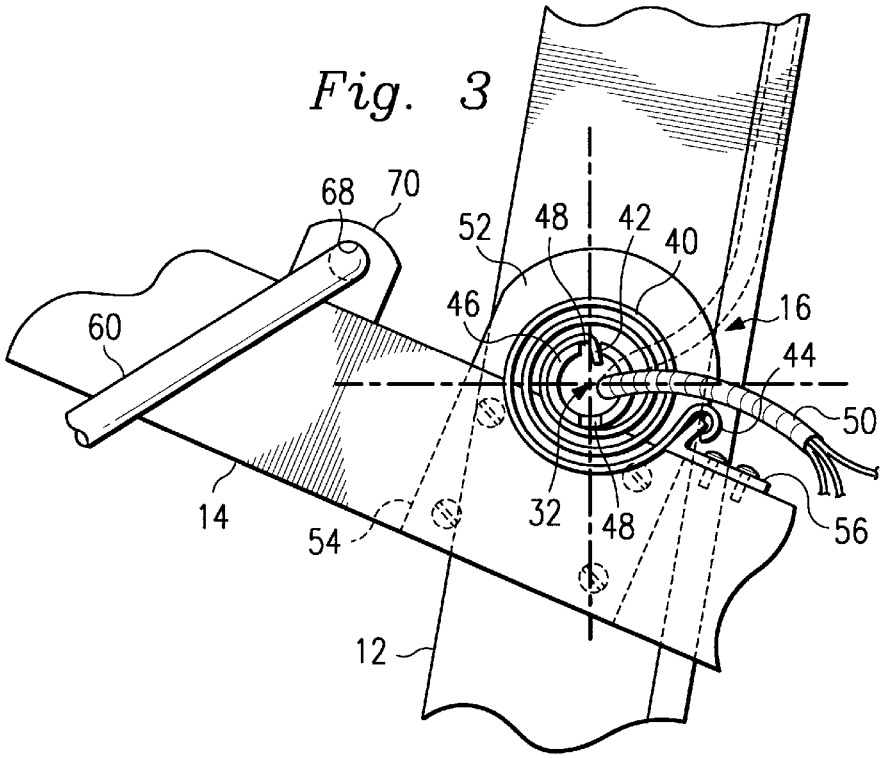
FIG. 3 is a close-up view of the region of FIG. 2B which reference numeral 3 indicates.

Referring now to FIG. 3, the resisting mechanism 16 includes at least one torsion, clock-type spring 40 at the main pivot axis 32. Ends 42 and 44 of the torsional spring 40 anchor between the main frame structure 12 and the pivoting frame 14, respectively. The torsion spring 40 mounts coaxially with respect to a hollow shaft or axle 46. The hollow shaft 46 is welded to the main frame structure 12. The hollow shaft 46 has a key way 48 into which the end 42 of the torsion spring 40 inserts. The hollow shaft 46 functions as both a pivot axle, on which the pivoting frame 14 may pivot, and as a conduit, through which wires 50 may pass between the main frame structure 12 and the pivoting frame 14. A bracket 52 has a hole (not shown) through which the hollow shaft 46 passes and in which it pivots. The bracket 52 has an end portion 54 which fastens to the pivoting frame 14. A hook 56 fastens to the pivoting frame 14. The hook 56 anchors the end 44 of the torsional spring 40 to the pivoting frame 14.

Figure 2A:
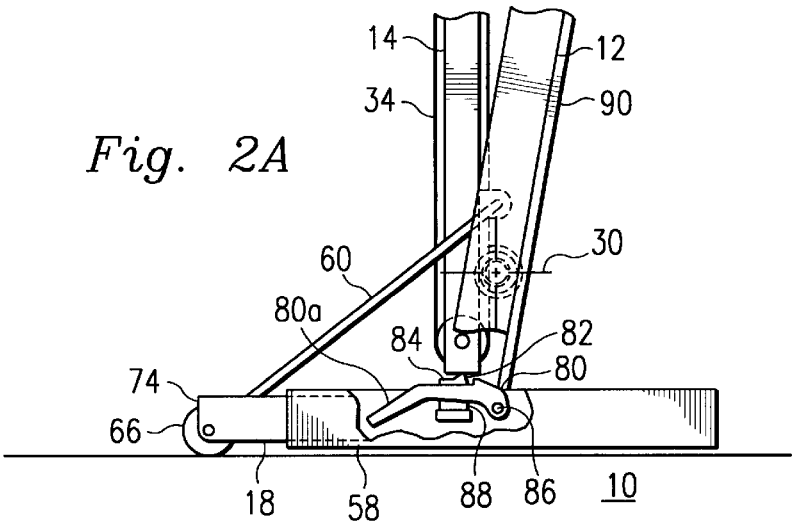
FIG. 2A is a partial break-away, side view of the preferred embodiment in a retracted position.
Figure 2B:
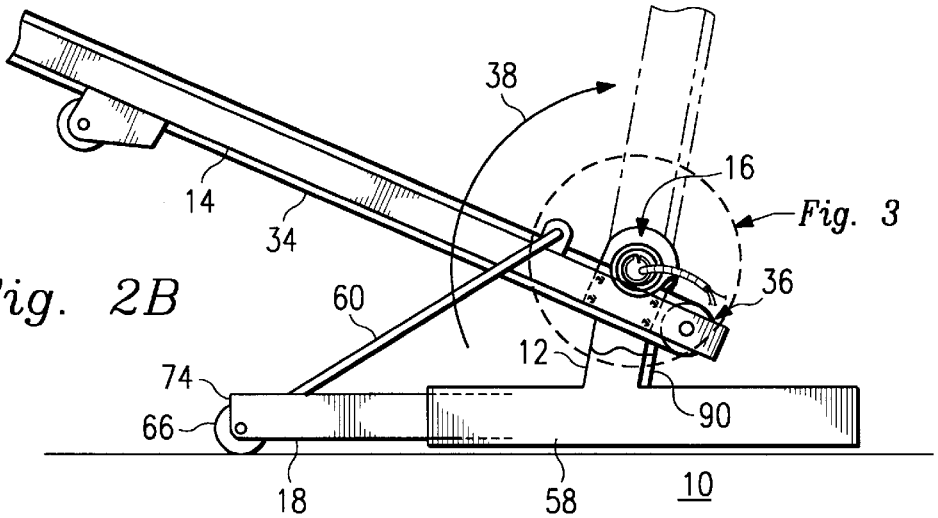
FIG. 2B is a partial break-away, side view of the preferred embodiment in an intermediate position.
Figure 2C:
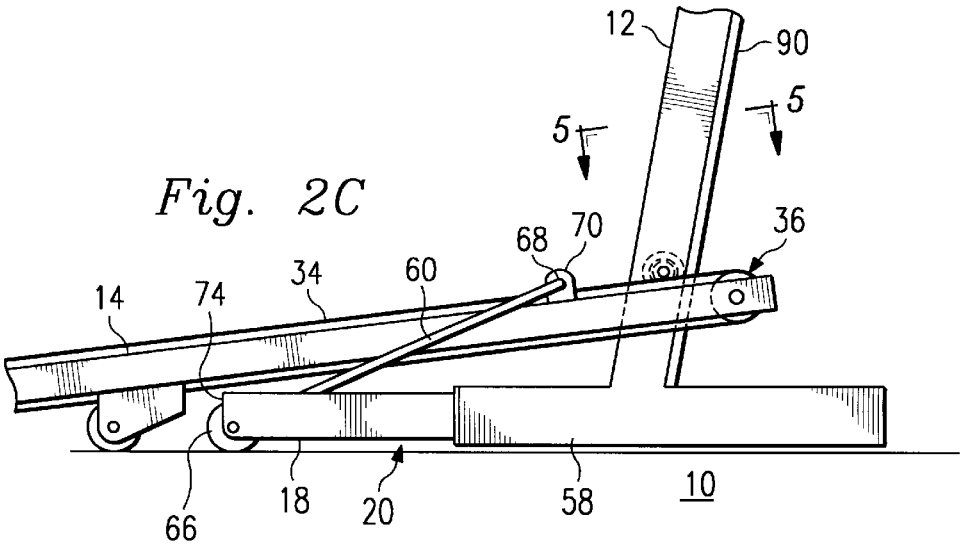
FIG. 2C is a side view of the invention in an operational position.

Referring now to FIGS. 2A - 2C, the articulating mechanism 20 is a slider-crank mechanism. The articulating mechanism 20 includes the stabilizer 18 which extends horizontally from a mating structure 58. The stabilizer 18 is the slider of the slider-crank mechanism. The pivoting frame 14 functions as the crank of the slider-crank mechanism. A linkage 60 functions as the rod of the slider-crank mechanism. Upon lowering the pivoting frame 14 from the vertical position to the horizontal position, the articulating mechanism 20 automatically articulates the stabilizer 18 from a stored, retracted position, shown in FIG. 2A, through an intermediate position, shown in FIG. 2B, to an extended position, shown in FIG. 2C, in which the treadmill 10 is ready for use.

Figure 4:
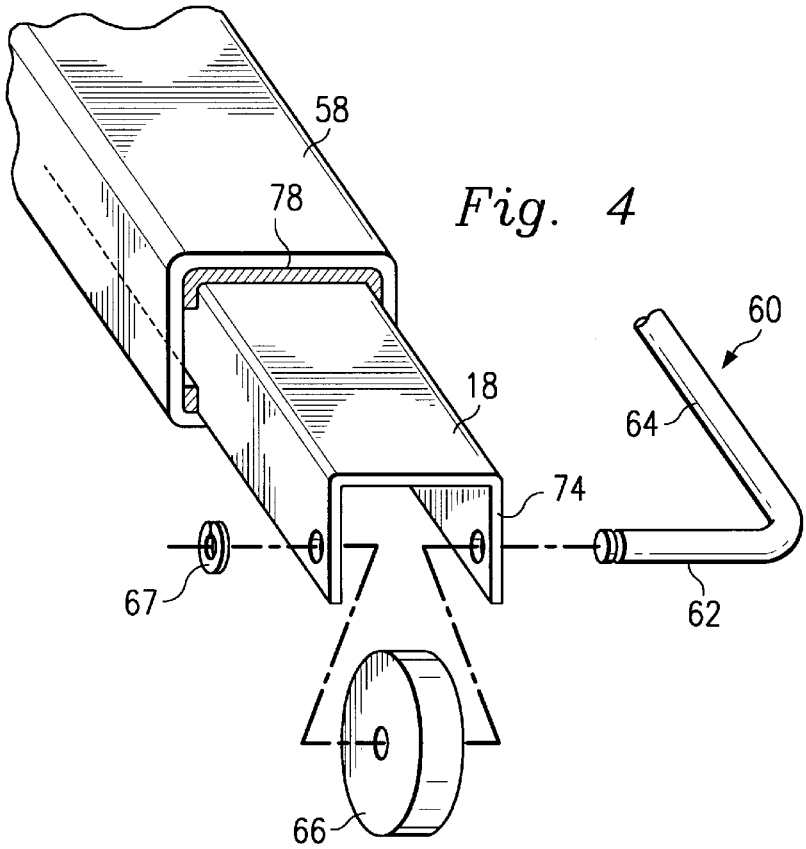
FIG. 4 is a perspective view of the stabilizer of the present invention.
Figure 5:
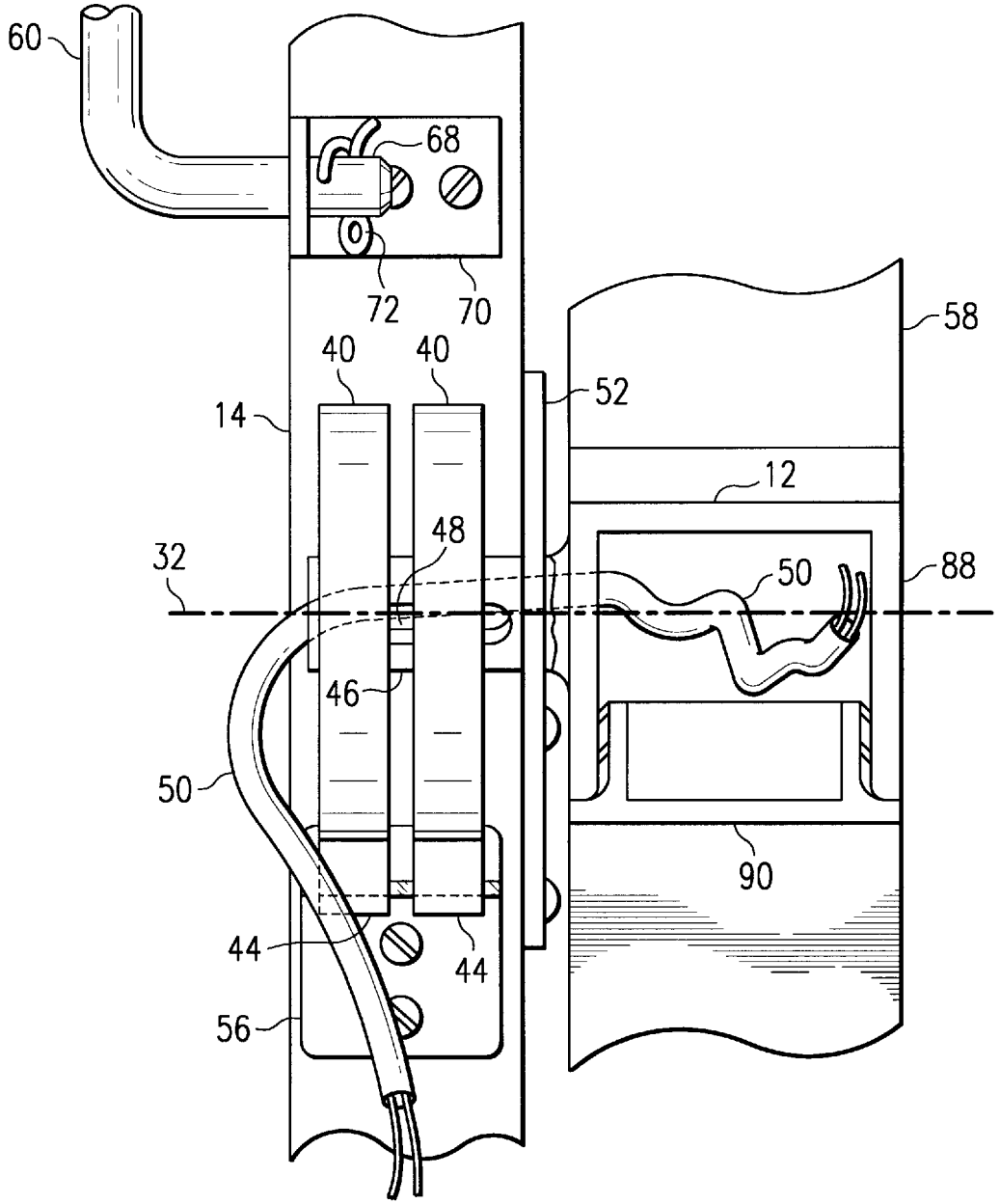
FIG. 5 is a partial, cross-sectional view taken along a plane which reference numeral 5 in FIG. 2C indicates.

Referring now to FIGS. 4 and 5, an end portion 62 of the linkage 60 bends 90 degrees, thus functioning as an axle to a roller or wheel 66. A retainer 67 retains the end portion 62 within the stabilizer 18. On an opposite end portion 68 of the linkage 60, the linkage is pivotally received into a bracket 70. A retainer 72 retains the end portion 68 in the bracket 70. The mating structure 58 is fixed to the main frame structure 12. A major portion 64 of the linkage 60 connects from the end portion 62 to the opposite end portion 68. The opposite end portion 68 has a pivot axis which is parallel to and not coaxial with the main pivot axis 32. The roller 66 mounts at an outboard end 74 of the stabilizer 18, thus minimizing friction during extension or retraction of the stabilizer. Plastic bushings 78 mount between the stabilizer 18 and the mating structure 58 and extend several inches into the structure, further helping to minimize friction by increasing the bushings' length-to-width ratios.

Referring again to FIG. 2A, a latch 80 pivotally mounts to the main frame structure 12 on pivot 86. A spring 88 upwardly biases the latch 80. When the pivoting frame 14 is in the stored, vertical position, a pawl 82 on the latch 80 engages a catch 84. The catch 84 attaches to the pivoting frame 14. The latch 80 locks the pivoting frame 14 to the main frame structure 12, thus preventing movement of the pivoting frame and enabling safe relocation of the treadmill 10. The user conveniently disengages the latch 80 by applying a force with his foot to a region 80*a* of the latch.

Referring now to FIG. 5, wires 50 run in an open channel 89 and through the hollow shaft 46 at the pivot axis 32. A plastic extrusion 90 inserts into the channel 89, thus forming a closed conduit which hides the wires 50. Because all that a technician must do to access the wires 50 is remove the extrusion 90, the technician need not route, feed, and pull the wires through the main frame structure 12. In addition, because the wires 50 pass through the hollow shaft 46 at the pivot axis 32, flexing of the wires is minimized when lifting or lowering the pivoting frame 14.

The present invention, as described herein, has many advantages over the prior art. For example, a technical advantage of the present invention is that the stabilizer 18 improves safety by improving the stability of the treadmill 10 after the pivoting frame 14 is lowered for use. When the pivoting frame 14 is in a horizontal position, the stabilizer 18 fully extends. This maximizes the footing of the treadmill 10, and thus minimizes the likelihood that the treadmill will tip when the user applies a force to the handle 30.

Another technical advantage is that the treadmill 10 folds into a small storage volume (or overall package size) when the user raises the pivoting frame 14 for storage, thus eliminating post purchase assembly or time-consuming disassembly when storing the device between uses, and saving valuable floor space.

Another technical advantage of the invention is that the stabilizer 18 automatically extends when a user lowers the pivoting frame 14, thus eliminating the danger that a negligent or forgetful user will fail to extend or install the stabilizer 18 when using the treadmill 10.

Another technical advantage of the invention is that the torsion spring 40 minimizes lifting and lowering forces which the user must impart when re-positioning the pivoting frame 14. The torsion spring 40 provides a constant torsional moment 38 which keeps the pivoting frame 14 in an up position whether or not the latch 80 is engaged.

Although an illustrative embodiment of the invention has been shown and described, other modifications, changes, and substitutions are intended in the foregoing disclosure. For example, instead of the hollow shaft 50 being welded to the main frame structure 12, the hollow shaft may be welded to the pivoting frame 14. In this alternate embodiment, the hook 56 would fasten to the main frame structure 12, instead of fastening to the pivoting frame 14. In addition, a variety of articulating mechanisms are contemplated, including a rack-and-pinion mechanism, a pulley and belt system (or a chain and sprocket system), a multi-bar linkage mechanism (including four-bar linkages), a semi-flexible ribbon and guide system in which the semi-flexible ribbon bends around a corner yet transmits compressive loads, or a combination of the mechanisms mentioned above. Accordingly, it is appropriate that the appended claims be construed broadly and consistent with the scope of the invention.

What is claimed is:

1. A treadmill which folds for storage and unfolds for operation on a floor, the treadmill comprising:

a. a main frame structure;

b. a pivoting frame which supports a conveyor and pivotally mounts to the main frame structure along a main pivot axis such that a user may pivot the pivoting frame between a substantially vertical position and a substantially horizontal position;

c. an articulating structure which connects to the main frame structure; and d. an articulating mechanism which, upon moving the pivoting frame between the vertical position and the horizontal position, automatically articulates the articulating structure between a stored, retracted position and an extended position in which the treadmill is stabilized.

2. The treadmill of claim 1, further including a resisting mechanism which applies a torsional resisting moment to the pivoting frame, the resisting moment opposing a moment which gravity induces on the pivoting frame.

3. The treadmill of claim 1, wherein the articulating mechanism is a slider-crank mechanism which includes a stabilizer having a linkage connected from an outboard end of the stabilizer to a pivot on the pivoting frame, wherein further the pivot has an axis which is parallel to and not coaxial with the main pivot axis.

4. The treadmill of claim 3, further including a resisting mechanism which applies a torsional resisting moment to the pivoting frame, the resisting moment opposing a moment which gravity induces on the pivoting frame.

5. The treadmill of claim 1, wherein the articulating structure is a stabilizer which extends horizontally from a mating structure which is fixed to the main frame structure.

6. The treadmill of claim 5, further including a resisting mechanism which applies a torsional resisting moment to the pivoting frame, the resisting moment opposing a moment which gravity induces on the pivoting frame.

7. The treadmill of claim 5, wherein a roller facilitates the extension of the stabilizer by reducing friction between the stabilizer and the floor as the stabilizer extends from the mating structure.

8. The treadmill of claim 7, further including a resisting mechanism which applies a torsional resisting moment to the pivoting frame, the resisting moment opposing a moment which gravity induces on the pivoting frame.

9. The treadmill of claim 1, wherein the articulating mechanism is a slider-crank mechanism which includes a stabilizer having a linkage connected from an outboard end of the stabilizer to a pivot on the pivoting frame, wherein the pivot has an axis which is parallel to and not coaxial with the main pivot axis, and wherein a minor portion of the linkage which is wider than the width of the stabilizer and which bends ninety degrees from a major portion of the linkage pivotally connects through the stabilizer.

10. The treadmill of claim 9, further including a resisting mechanism which applies a torsional resisting moment to the pivoting frame, the resisting moment opposing a moment which gravity induces on the pivoting frame.

11. The treadmill of claim 9, wherein the minor portion of the linkage is an axle to a roller.

12. The treadmill of claim 11, further including a resisting mechanism which applies a torsional resisting moment to the pivoting frame, the resisting moment opposing a moment which gravity induces on the pivoting frame.

13. The treadmill of claim 2, wherein the resisting mechanism comprises at least one torsion spring at the main pivot axis anchored between the main frame structure and the pivoting frame.

14. The treadmill of claim 13, wherein the torsion spring mounts coaxially with respect to a hollow shaft which mounts to a structure, the hollow shaft functioning as both a pivot axle, on which the pivoting frame may pivot, and a conduit, through which wires may pass between the main frame structure and the pivoting frame.

15. The treadmill of claim 14, wherein the structure is the main frame structure.

16. The treadmill of claim 14, wherein the structure is the pivoting frame.

17. A treadmill which folds for storage and unfolds for operation on a floor, the treadmill comprising:

a. a main frame structure;

b. a pivoting frame which supports a conveyor and pivotally mounts to the main frame structure along a main pivot axis such that a user may pivot the pivoting frame between a substantially vertical position and a substantially horizontal position;

c. a resisting mechanism which applies a torsional resisting moment to the pivoting frame, the resisting moment opposing a moment which gravity induces on the pivoting frame, wherein the resisting mechanism comprises at least one torsion spring mounted coaxially with respect to a hollow shaft which mounts to a structure at the main pivot axis anchored between the main frame structure and the pivoting frame, the hollow shaft functioning as both a pivot axle, on which the pivoting frame may pivot, and a conduit, through which wires may pass between the main frame structure and the pivoting frame.

18. The treadmill of claim 17, wherein the structure is the main frame structure.

19. The treadmill of claim 17, wherein the structure is the pivoting frame.

20. A treadmill which folds for storage and unfolds for operation on a floor, the treadmill comprising:

a. a main frame structure;

b. a pivoting frame which supports a conveyor and pivotally mounts to the main frame structure along a main pivot axis such that a user may pivot the pivoting frame between a substantially vertical position and a substantially horizontal position;

c. a resisting mechanism which applies a torsional resisting moment to the pivoting frame, the resisting moment opposing a moment which gravity induces on the pivoting frame;

d. an articulating structure which connects to the main frame structure; and e. an articulating mechanism which, upon moving the pivoting frame between the vertical position and the horizontal position, automatically articulates the articulating structure between a stored, retracted position and an extended position in which the treadmill is stabilized.

21. The treadmill of claim 20, wherein the articulating mechanism is a slider-crank mechanism which includes a stabilizer having a linkage connected from an outboard end of the stabilizer to a pivot on the pivoting frame, wherein further the pivot has an axis which is parallel to and not coaxial with the main pivot axis.

22. The treadmill of claim 20, wherein the articulating structure is a stabilizer which extends horizontally from a mating structure which is fixed to the main frame structure.

23. The treadmill of claim 22, wherein a roller facilitates the extension of the stabilizer by reducing friction between the stabilizer and the floor as the stabilizer extends from the mating structure.

* * * * *